US008540227B2

(12) United States Patent
Buri

(10) Patent No.: US 8,540,227 B2
(45) Date of Patent: Sep. 24, 2013

(54) ACCUMULATING APPARATUS FOR DISCRETE PAPER OR FILM OBJECTS AND RELATED METHODS

(76) Inventor: Reinhard Buri, Donaueschingen/Pfohren (DE)

( * ) Notice: Subject to any disclaimer, the term of this patent is extended or adjusted under 35 U.S.C. 154(b) by 0 days.

(21) Appl. No.: 13/260,611

(22) PCT Filed: Apr. 6, 2010

(86) PCT No.: PCT/US2010/030066

§ 371 (c)(1),
(2), (4) Date: Dec. 14, 2011

(87) PCT Pub. No.: WO2010/118001

PCT Pub. Date: Oct. 14, 2010

(65) Prior Publication Data

US 2012/0079797 A1 Apr. 5, 2012

Related U.S. Application Data

(60) Provisional application No. 61/167,026, filed on Apr. 6, 2009.

(51) Int. Cl.
*B65H 33/04* (2006.01)

(52) U.S. Cl.
USPC ..... 270/58.01; 270/59; 271/198

(58) Field of Classification Search
USPC ..... 271/198; 270/45, 46, 12, 58.01, 270/59
See application file for complete search history.

(56) References Cited

U.S. PATENT DOCUMENTS

| | | | | |
|---|---|---|---|---|
| 3,785,256 | A * | 1/1974 | Nikkel | 414/789 |
| 4,640,506 | A * | 2/1987 | Luperti et al. | 271/212 |
| 4,925,180 | A * | 5/1990 | Golicz | 271/198 |
| 5,147,092 | A * | 9/1992 | Driscoll et al. | 271/184 |
| 5,178,379 | A * | 1/1993 | Edwards et al. | 271/189 |
| 5,244,200 | A * | 9/1993 | Manzke | 271/198 |
| 5,342,038 | A * | 8/1994 | Suter | 271/198 |
| 5,775,689 | A * | 7/1998 | Moser et al. | 271/198 |
| 6,644,657 | B2 * | 11/2003 | Wright et al. | 271/242 |
| 7,581,726 | B2 * | 9/2009 | Seiler | 271/3.01 |

OTHER PUBLICATIONS

European Patent Office; Search Report and Written Opinion in International Patent Application No. PCT/US2010/030066 dated Apr. 8, 2011; 17 Pages.

* cited by examiner

*Primary Examiner* — Kaitlin Joerger
(74) *Attorney, Agent, or Firm* — Wood, Herron & Evans, LLP

(57) ABSTRACT

An apparatus is provided for accumulating discrete paper or film objects traveling in a machine direction. A first accumulator element of the apparatus is rotatable about a first axis of rotation. A second accumulator element is disposed in confronting relationship with the first accumulator element and has a first, generally flat surface, and a first arcuate surface. Both of these surfaces are rotatable about the first axis of rotation and the first accumulator element has a first angular position that defines a first gap relative to the second accumulator element for receiving the objects there between. The first accumulator element has a second angular position that defines a second gap relative to the second accumulator element for moving the objects in the machine direction, with the second gap being smaller than the first gap.

34 Claims, 9 Drawing Sheets

ACCUMULATING APPARATUS FOR DISCRETE PAPER OR FILM OBJECTS AND RELATED METHODS

CROSS-REFERENCE TO RELATED APPLICATIONS

This application claims the filing date priority benefit of U.S. Patent Application Ser. No. 61/167,026, filed Apr. 6, 2009 entitled "Accumulating Apparatus for Discrete Paper or Film Objects and Related Methods," the disclosure of which is expressly incorporated by reference herein in its entirety.

TECHNICAL FIELD

The present invention generally relates to converting equipment and, more particularly, to apparatus for converting paper into sheets, collating and automatic envelope stuffing operations.

BACKGROUND

Converting equipment is known for automatically stuffing envelopes. Such equipment may include components for feeding a pre-printed web of paper, for cutting such web into one or more discrete sheets for collating sheets, and for feeding such discrete sheet collations into envelopes. Such equipment may further include components to convey the stuffed envelopes to a specified location. The industry has long known apparatus which accomplish these and other functions. However, improvements are needed where high volumes of paper piece count and high speeds are required without sacrificing reliability, accuracy and quality of end product.

More particularly, a large roll of paper is typically printed in discrete areas with piece specific information. That is, the initial roll of paper comprises vast numbers of discrete areas of already-printed indicia-specific information with each discrete area defining what is to eventually comprise a single page or sheet of indicia specific information. To complicate the process, a variable number of sheets with related indicia must be placed into the envelopes so that the content of one envelope varies from the content of another by sheet count and, of course, by the specific indicia on the included sheets. As one example, financial reports of multiple customers or account specifics may require a varied number of customer or account specific sheets to be cut, respectively collated, stuffed and discharged for delivery. Thus, the contents of each envelope include either a single sheet or a "collation" of from two to many sheets, each "collation" being specific to a mailing to an addressee.

In such an exemplary operation, a financial institution might send billing or invoice information to each of its customers. The billing information or "indicia" for one customer may require anywhere from one final sheet to a number of sheets which must be collated, then placed in that customer's envelope. While all this information can be printed in sheet size discrete areas, on a single roll, these areas must be well defined, cut, merged or collated into sheets for the same addressee or destination, placed into envelopes, treated and discharged. Thus, a system for conducting this process has in the past included certain typical components, such as a paper roll stand, drive, sheet cutter, merge unit, accumulate or collate unit, folder, envelope feeder, envelope inserter, and finishing and discharge units. Electronic controls are used to operate the system to correlate the functions so correct sheets are collated and placed in correct destination envelopes.

In such multi-component systems, the pass-through rate from paper roll to finished envelope is dependent on the speed of each component, and overall production speed is a function of the slowest or weakest link component. Overall reliability is similarly limited. Moreover, the mean down time from any malfunction or failure to repair is limited by the most repair-prone, most maintenance consumptive component. Such systems are capital intensive, requiring significant floor plan or footprint, and require significant labor, materials and maintenance capabilities and facilities.

In such a system, it is sometimes necessary to accumulate folded or unfolded discrete inserts made of paper or film while another operation takes place. For example, and without limitation, a particular batch or job may require stuffing an envelope with a relatively high number of folded inserts, such as 20, while a folding apparatus that is part of the system can only handle 10 inserts at a time. In such situation, it may be necessary to accumulate the inserts thereby forming a first stack of 10 inserts and feed the stack to the folder for processing while forming and thereby accumulating a second stack of 10 inserts for subsequent feeding to the folder.

Conventional apparatus used for accumulating discrete objects may include a pair of rollers in confronting relationship and contacting one another, with the discrete inserts being fed towards and held by the rollers which are typically stopped. As the stack of inserts forms and the thickness thereof increases beyond a certain magnitude, the resulting stack is staggered (i.e., in cascade fashion), for example such that each leading edge of the inserts follows the general circumference of one of the rollers, at a slightly different position, causing each successive sheet to stop slightly behind the leading edge of the preceding sheet. The resulting stack of inserts, accordingly, is one where one or more of the leading edges of the sheets do not coincide with one another, which may lead to handling problems downstream in the direction of travel of the stack.

In accumulating a stack of objects such as discrete paper sheets, it is desirable for the leading edges of the sheets to be in, or form, a flat leading edge of the accumulated stack and not to be staggered at different positions relative to each other. In the past, paper feeders such as rollers, tended to form stacks with such staggered or inclined leading edges.

Accordingly, it is desirable to provide an improved apparatus and related methods for accumulating discrete paper or film objects such as sheets in a high speed handling machine. It is also desirable to provide a transportation system and related methods that address inherent problems observed with conventional paper systems. Moreover, it is desirable to provide a converting apparatus in the form of an automatic envelope stuffing machine that address the problems of conventional machines for stuffing envelopes, such as the formation of stacks of inserts with staggered edges.

SUMMARY

To these ends, in some embodiments, an apparatus accumulates discrete paper or film objects to thereby form a stack with a uniform rather than a staggered profile, and which may include accumulator elements that accelerate to match a required speed downstream in the direction of travel of the objects.

More particularly, in one specific embodiment of the invention, an apparatus is provided for accumulating discrete paper or film objects traveling in a machine direction. A first accumulator element of the apparatus is rotatable about a first axis of rotation. A second accumulator element is disposed in confronting relationship with the first accumulator element and has a first, generally flat surface, and a first arcuate surface. Both of these surfaces are rotatable about the first axis of rotation and the first accumulator element has a first angular position that defines a first gap relative to the second accumulator element for receiving the objects there between. The first accumulator element has a second angular position that defines a second gap relative to the second accumulator element for moving the objects in the machine direction, with the second gap being smaller than the first gap. A stop of the apparatus is oriented transverse to the first axis of rotation and rotates about that first axis. The stop is configured to prevent movement of the objects in the machine direction when the first accumulator element is in the first angular position.

In another embodiment, an apparatus is provided for accumulating discrete paper or film objects traveling in a machine direction. The apparatus includes a first cam and a second cam. The first cam is rotatable about a first axis of rotation and the second cam is rotatable about a second axis of rotation that is generally parallel to the first axis of rotation. The second cam is disposed in confronting relationship with the first cam. The apparatus also includes a first stop that is oriented transverse to the first axis of rotation and which is rotatable thereabout. A second stop is oriented transverse to the second axis of rotation and is rotatable about that second axis. The first and second cams have a first common angular position that defines a first gap between them, and a second common angular position that defines a second gap between the cams. The first gap is wider than the second gap and is configured to receive the objects there between, and the second gap is effective to nip the objects there between to move the objects in the machine direction. The first and second stops are configured to prevent movement of the objects in the machine direction when the objects are received in the first gap.

In another embodiment, an automatic converting apparatus is provided. The converting apparatus has a first end that is associated with feeding of a roll of paper in a machine direction, a portion configured to process the roll of paper into discrete paper objects, and a second end associated with feeding of envelopes toward the discrete objects. The converting apparatus also has an accumulating apparatus that is configured for accumulating the discrete objects traveling in the machine direction. The accumulating apparatus includes first and second accumulator elements disposed in confronting relationship with one another. The first accumulator element is rotatable about a first axis of rotation and has a first angular position that defines a first gap relative to the second accumulator element for receiving the discrete objects there between. The first accumulator element also has a second angular position that defines a second gap relative to the second accumulator element for nipping and moving the discrete objects in the machine direction. The second gap is smaller than the first gap. The accumulating apparatus also has a stop that is oriented transverse to the first axis of rotation and which is rotatable about that first axis. The stop is configured to prevent movement of the discrete objects in the machine direction when the first accumulator element is in the first angular position.

In yet another embodiment, a paper sheet stacking apparatus is provided. The apparatus includes an accumulator element that has an abutting surface defining first and second paper receiving nips, with the first nip being wider than the second nip. The stacking apparatus also has a stop for blocking leading edges of successively fed paper sheets in generally the same position and thereby form a stack of sheets having a generally uniform leading edge. The sheets are dispensed within the first nip. The accumulator element may be rotatable to define the second nip for engaging and driving the formed stack in a downstream direction.

In another embodiment, a method is provided for accumulating discrete paper or film objects traveling in a machine direction. The method includes defining a first gap between first and second accumulator elements to receive the objects there between, the first gap being associated with a first angular position of the first accumulator element. The first accumulator element is rotated to define a second gap between the accumulator elements and which is associated with a second angular position of the first accumulator element. The second gap is smaller than the first gap and engagement of the objects with surfaces defining the second gap is effective to move the objects in the machine direction. Movement of the objects traveling in the machine direction is blocked when the objects are received in the first gap.

In yet another embodiment, a method is provided for accumulating a plurality of paper or film objects. A first one of the objects is moved in a machine direction into a space defined between a pair of rotatable accumulator elements that are in a non-rotating angular position. A second one of the objects is then moved toward a position above or below the first object to thereby form a stack of the objects. The stack of the objects is supported with an apparatus downstream from the accumulator elements and which is operable to move the stack in the machine direction at a first speed. Rotation of the accumulator elements is accelerated from the non-rotating position to a transfer position in which the stack of the objects is moving substantially at the first speed of the apparatus downstream and the stack of the objects is transferred away from engagement with the accumulator elements and into engagement with the apparatus downstream thereof.

Such apparatus and methods are particularly useful in a paper converting and envelope stuffing system contemplating improved paper converting and sheet inserting apparatus and methods, modular based, and having improved paper handling apparatus, servo driven components, improved sensor density and improved control concepts controlling the system operation. One or more of the embodiments of the invention contemplate the provision of an improved envelope conveying apparatus which can be used as a module of a modular paper converting and sheet insertion system where human capital, required space, required equipment, maintenance, labor and materials and facilities therefore are reduced compared to conventional systems of similar throughput.

More specifically, such improved apparatus and methods contemplate a plurality of functional modules providing the following functions in a series of modules of like or dissimilar modules where a specific module is multi-functional. The functions comprise:

printed paper roll handling/unwinding;
paper slitting and cutting;
sheet collation and accumulation;
sheet folding;
transportation for interfacing with inserts;
envelope feeding;
collation interfacing and insertion; and
envelope treating and discharge.

More particularly, one or more aspects of the invention may contemplate, without limitation, new and unique apparatus and methods for:

(a) guiding a web of the paper or film containing the printed indicia into a cutter apparatus;
(b) processing the web through slitting and transverse-cutting operation;
(c) transporting and merging discrete pieces of the insert;

(d) accumulating predefined stacks of discrete pieces of the insert;

(e) guiding and transporting a stack of discrete pieces of the insert toward an envelope-filling station;

(f) transporting individual envelopes toward the envelope-filling station;

(g) creating and processing a stack of the envelopes prior to the envelope-filling process; and (h) processing an individual envelope from the stack of envelopes and through the envelope-filling station.

While the combination of the particular functions in the particular modules are unique combinations, the invention of this application lies primarily in the paper transporting apparatus and methods described herein.

In accordance with various embodiments of this invention, a plurality of objects such as paper sheets are sequentially fed to a nip or gap formed between two paper conveying, intermittently accumulator elements. Respective surfaces of the elements are rebated from the circumference of the curvilinear edges so that the nip or gap formed between the rebated edges is larger than the nip or gap formed by the circumferential edges. Paper sheets are fed to one or more stops between the larger nip where a stack having a flush, smooth leading edge, is formed in the larger nip. Thereafter, the accumulator elements are driven to engage and drive the whole stack, with a smooth flat leading edge, in a machine direction for further processing of the stack.

In some embodiments, the stop or stops comprise fingers radially extending from either or both of the accumulator elements or their drive axles in a predetermined angular position so as to stop leading edges of successively introduced sheets at generally the same location before the stack is conveyed further by the accumulator elements.

DETAILED DESCRIPTION

Figure 1:
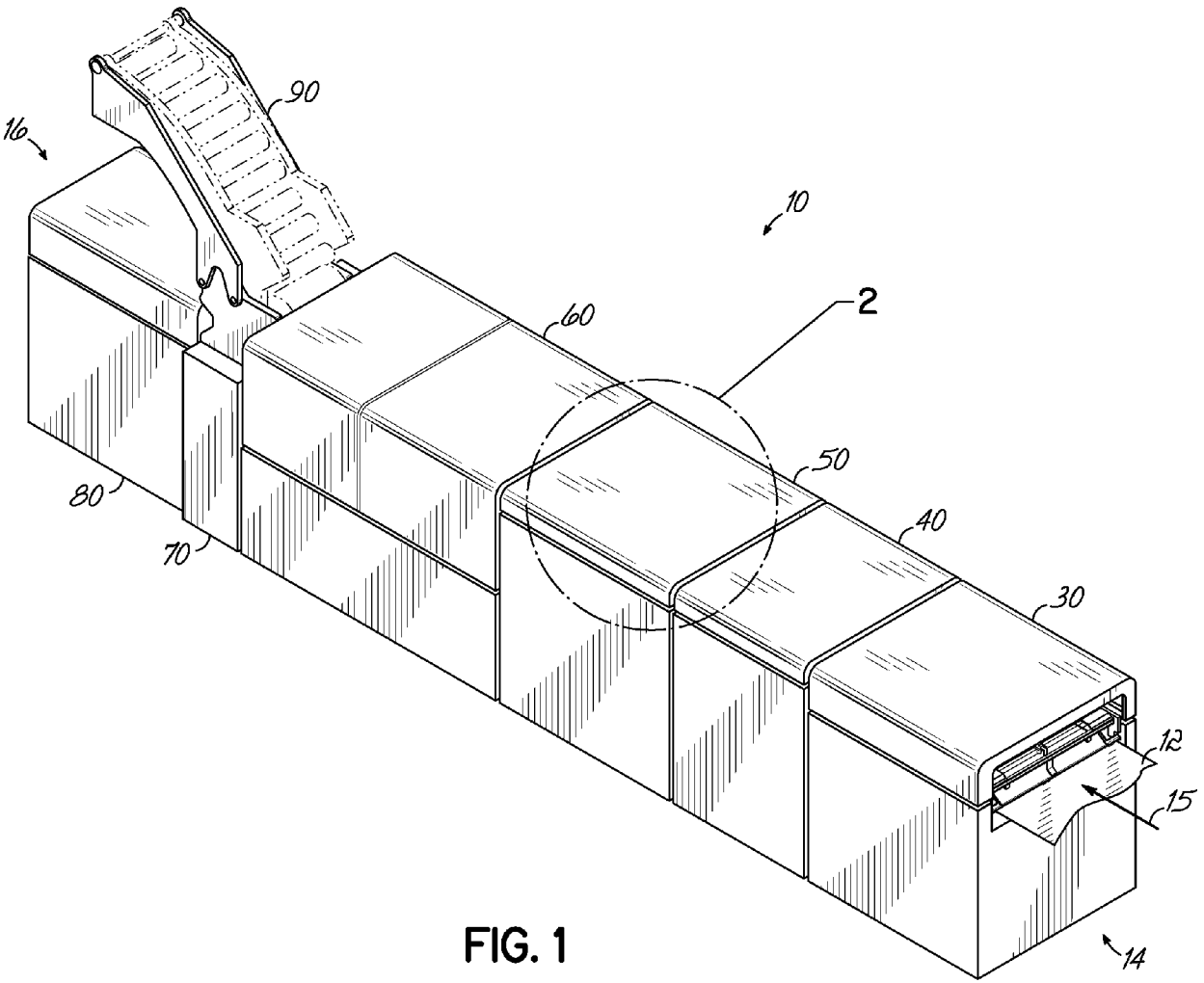
FIG. 1 is a perspective view illustrating a portion of a converter for stuffing envelopes with selected paper or film objects.

Referring to the figures and, more particularly to FIG. 1, a portion of an exemplary converter 10 is illustrated for processing a web 12 of paper or film. Although not shown, the web 12 processed by the converter 10 originates, for example, from a roll (not shown) of material containing such web 12. The roll is generally associated with a first end 14 of the converter 10 and is unwound in ways known in the art, for example, by driving a spindle receiving a core of the roll or by contacting a surface of the roll with a belt or similar apparatus. Typically, the web 12 is pre-printed with indicia in discrete areas.

The web 12 thus travels in a machine direction, generally indicated by arrow 15, through several modules that make up the converter 10. In the exemplary embodiment of FIG. 1, converter 10 cuts the web material into discrete sheets (corresponding to the "areas") of material ("inserts") and feeds them into envelopes fed generally from an opposite end 16 of converter 10. Converter 10 may further convey the envelopes containing the inserts away from the shown portion of the converter 10 for subsequent processing or disposition. The exemplary converter 10 includes, as noted above, several modules for effecting different steps in the processing of the web 12 and the inserts resulting therefrom, as well as processing of the envelopes. Those of ordinary skill in the art will readily appreciate that converter 10 may include other modules in addition or instead of those shown herein.

A first of the shown modules, for example, is a cutting module 30 relatively proximate first end 14 of the converter 10 and which cuts the web 12 into discrete objects such as inserts (FIG. 2) for subsequent processing. A conveying module 40 controls and transports the discrete inserts received from the cutting module and feeds them into a folding and buffering module 50. Module 50 may, if necessary, form stacks of the discrete inserts for subsequent processing, for example, if the intended production requires stuffing the envelopes with inserts defined by more than one discrete sheet. Module 50 folds the discrete inserts, if required by the intended production, along a longitudinal axis of the discrete inserts disposed generally along the machine direction. Moreover, module 50 accumulates, collates or buffers sets of the discrete sheets into individually handled stacks, if the particular production so requires.

With continued reference to FIG. 1, an uptake module 60 takes the inserts from folding and buffering module 50 and cooperates with components of a stuffing module 70 to transport the inserts and feed them into envelopes. The envelopes, in turn, are handled and fed toward the stuffing module 70 by an envelope conveyor 80. A conveying assembly 90 is operatively coupled to the stuffing module 70 and the envelope conveyor 80 for conveying the stuffed or filled envelopes away from the shown portion of converter 10 for subsequent processing or disposition.

Figure 2:
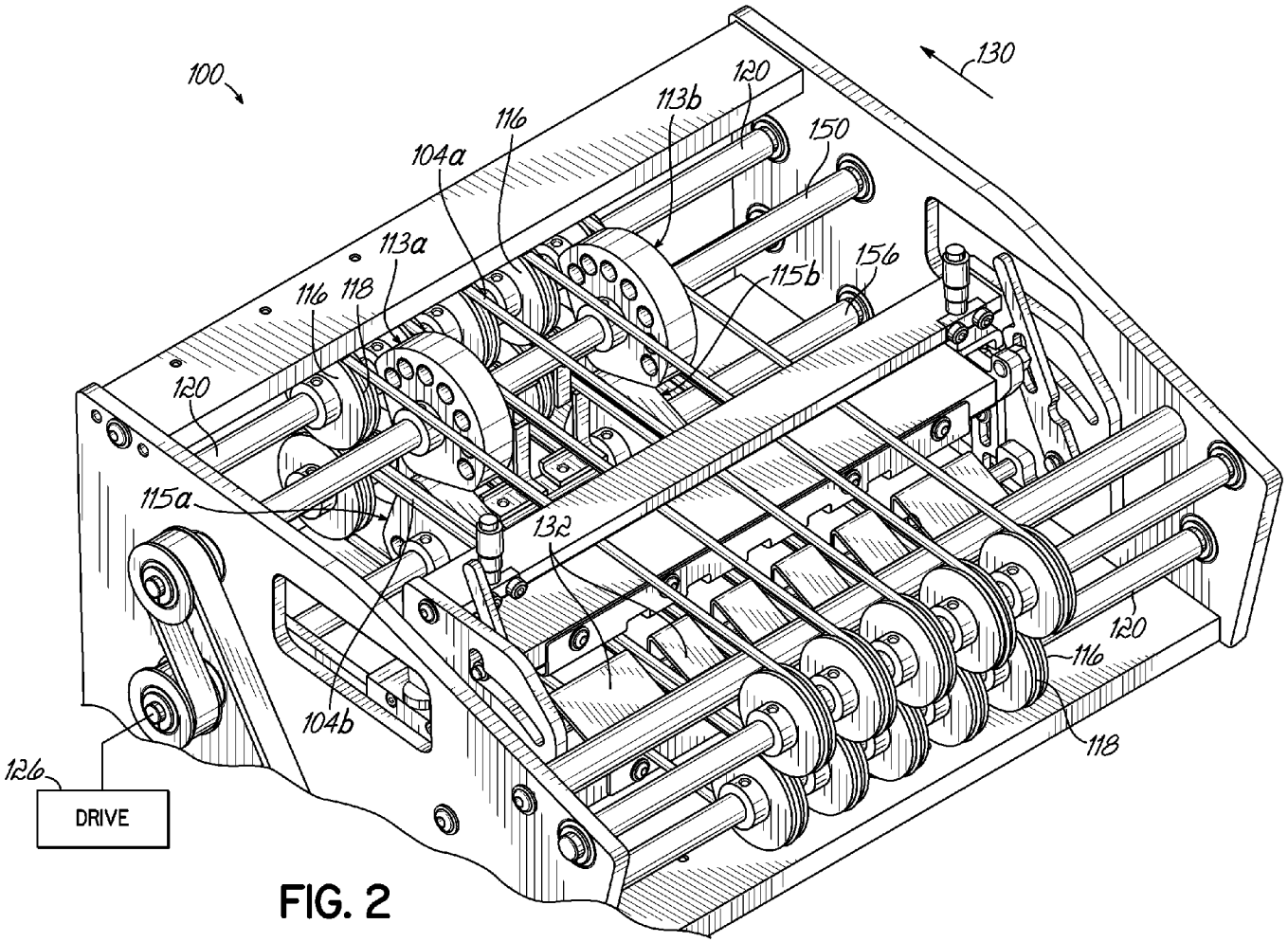
FIG. 2 is a perspective view of an interior portion of an accumulating apparatus associated with the encircled area of FIG. 1.
Figure 3:
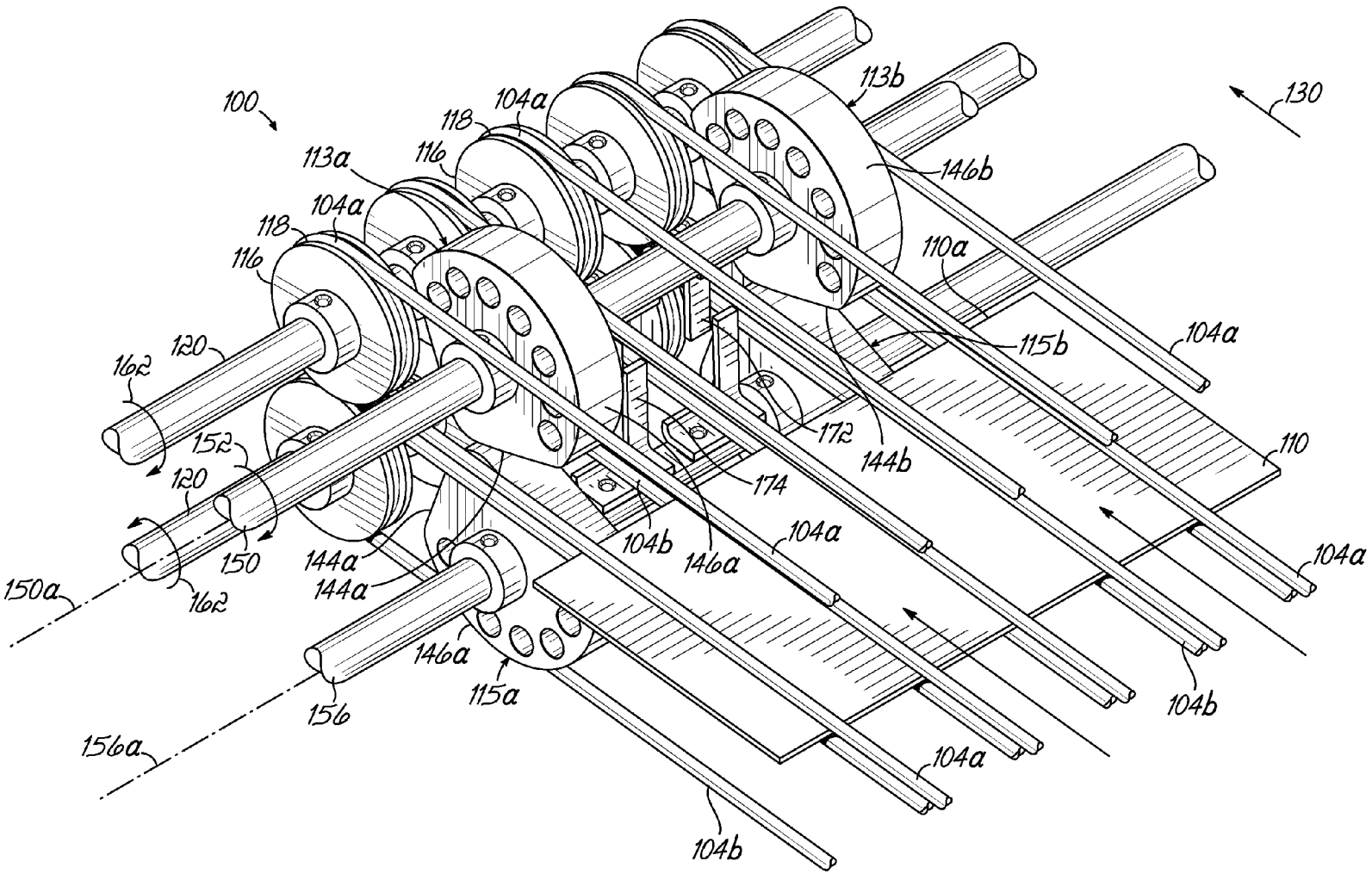
FIG. 3 is a perspective view of a portion of the transporting apparatus of FIG. 2.

With reference to FIGS. 2-7, and with particular reference to FIGS. 2-3, an interior of the folding and buffering module 50 is illustrated. Module 50 includes an accumulating apparatus 100 having a plurality of belts 104*a*, 104*b* for feeding discrete film or paper objects 110 toward two sets of rotatable accumulator elements 113*a*, 115*a* and 113*b*, 115*b* of the accumulating apparatus 100. In this regard, the belts 104*a*, 104*b* are driven by pulleys 116 that have respective grooves 118 on their circumferential surfaces, which allow the belts 104*a*, 104*b* to ride on and be secured relative to the pulleys 116. The pulleys 116, in turn, are driven by drive shafts 120 coupled to one or more drives (not shown) that selectively rotate the shafts 120. Movement of the belts 104*a*, 104*b* generally along their respective length dimensions result in movement of the discrete objects 110 in the machine direction (arrow 130). Respective pairs of top and bottom belts 104*a*, 104*b* are spaced from one another so as to engage and move the objects 110 in the machine direction (arrow 130) toward the two sets of accumulator elements 113*a*, 115*a* and 113*b*, 115*b*. As explained in further detail below, a plurality of adjustable ramps 132 of the apparatus 100 can direct the vertical position of each of the objects 110 relative to other ones of the objects 110 as the objects 110 travel toward the accumulator elements 113*a*, 115*a* and 113*b*, 115*b*.

With particular reference to FIG. 3, the accumulating apparatus 100 has a first set of accumulator elements 113*a*, 113*b* laterally spaced from one another and which are respectively in confronting relationship relative to a second opposed set of accumulator elements 115*a*, 115*b*. Each of the accumulator elements 113*a*, 113*b* of the first set, in this embodiment, is in the general form of a cam having at least one generally flat surface 144*a*, 144*b* and an arcuate surface 146*a*, 146*b*. The accumulator elements 113*a*, 113*b* of the first set are mounted on a first common shaft 150 and therefore rotate about a first axis 150*a* of the shaft 150 in the general direction of arrow 152, while the accumulator elements 115*a*, 115*b* of the second set are mounted on a second common shaft 156 and rotate about a second axis 156*a* that is generally parallel to the first axis 150*a*. The first and second common shafts 150, 156 are operatively coupled to a schematically-depicted drive 126 that is actuatable to rotate the accumulator elements 113*a*, 113*b*, 115*a*, 115*b* to predetermined angular positions. As explained in further detail below, rotation of the accumulator elements 113*a*, 113*b*, 115*a*, 115*b* causes nipping engagement of the arcuate surfaces 146*a*, 146*b* with the object 110, such that, when engaged, the accumulator elements 113*a*, 113*b*, 115*a*, 115*b* drive the object 110 in the machine direction (arrow 130). As shown in FIG. 3, rotation of the pulleys 116 (arrows 162) is such that they drive movement of several pairs of confronting top and bottom belts 104*a*, 104*b* also in the machine direction (arrow 130), with movement of each pair of confronting belts 104*a*, 104*b*, and particularly their engagement with the objects 110, in turn, moving the objects 110 also in the machine direction (arrow 130).

Figure 4:
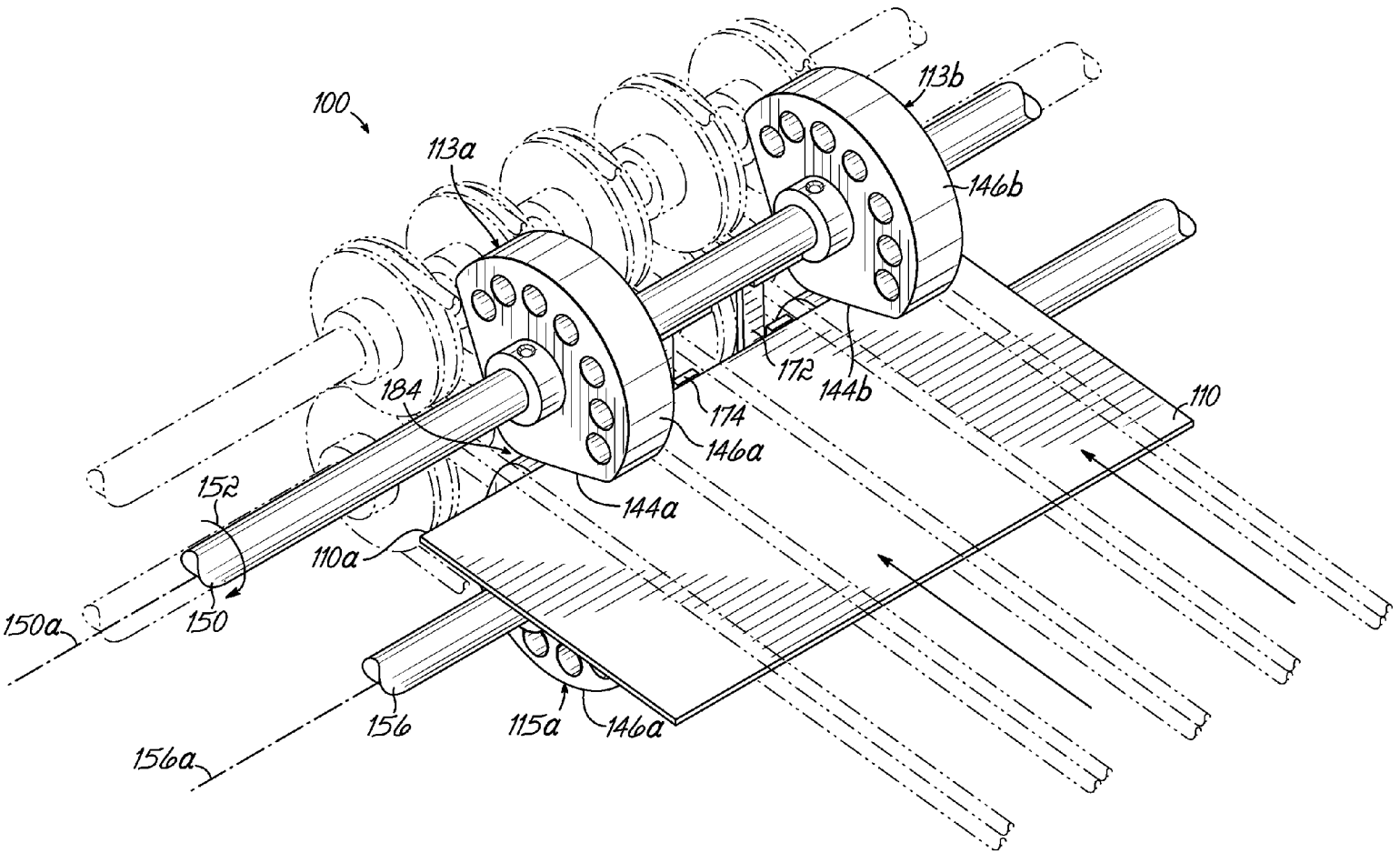
FIG. 4 is a perspective view of the accumulating apparatus of FIGS. 2 and 3 illustrating the apparatus relative to a discrete paper or film object.

With particular reference to FIG. 4, movement of the object 110 in the machine direction (arrow 130) is blocked (i.e., stopped) by one or more stops of the apparatus 50. The illustrated embodiment has one or more pairs of stops 172, 174 in the form of top and bottom plates that are respectively oriented transverse to the first and second axes of rotation 150*a*, 156*a*. More specifically, the stops 172, 174 are aligned generally in the same plane with one another such as to define a positive stop that contacts the leading edge 110*a* of each of the objects 110 as the objects 110 move into a nip or gap 184 defined between each pair of confronting ones of the accumulator elements 113*a*, 113*b*, 115*a*, 115*b*. In operation, once an object 110 is stopped by the stops 172, 174, continuous movement of the top and bottom belts 104*a*, 104*b* results in the top and bottom belts 104*a*, 104*b* slipping relative to the object 110. In an alternative embodiment (not shown), it is contemplated that the belts 104*a*, 104 may instead be positioned so as not to extend as illustrated, but rather extend to a location upstream of the gap 184. In that alternative embodiment, once the object 110 is stopped in front of the gap 184, there is no further contact between the belts 104*a*, 104*b* such that continuous movement of the belts 104*a*, 104*b* does not result in slippage thereof relative to the object 110.

With particular reference to FIGS. 5, 5A, 5B, 6, and 7, an exemplary operation of the accumulating apparatus 100 is illustrated. For ease of understanding, the figures and their description refer only to one pair of confronting accumulator elements 113*a*, 115*a*, noting that the same principles may generally apply to the other pair of opposed accumulator elements 113*b*, 115*b* shown in FIGS. 2-4. The accumulator elements 113*a*, 115*a* of the first pair are in the form of top and bottom accumulator elements 113*a*, 115*a* depicted in FIG. 5 in a first common, non-rotating angular position. In this first or home angular position, the flat surface 144*a* of the top accumulator element 113*a* is in general confronting relationship with the flat surface 144*a* of the bottom accumulator element 115*a*, thereby defining a vertical space $d_1$ of the gap 184 between the top and bottom accumulator elements 113*a*, 115*a*. In this first common angular position of the top and bottom accumulator elements 113*a*, 115*a*, the two stops 172, 174 are shown in general alignment with one another (i.e., they are coplanar) so as to provide a positive stopping or blocking surface preventing forward movement of the object 110 in the machine direction (arrow 130). Accordingly, a first object 110 advances into the gap 184 toward the stops 172, 174, with further movement of the object 110 in the machine direction (arrow 130) being prevented by the stops 172, 174. In one aspect of this embodiment, the top and bottom accumulator elements 113*a*, 115*a* are stopped in this first common angular position, to thereby define a home position for the top and bottom accumulator elements 113*a*, 115*a*. Movement in the machine direction (arrow 130) of additional objects will result in the formation of a stack of the objects 110, the leading edges 110*a* of which will be in general vertical alignment with one another and abutting one or both of the stops 172, 174.

Figure 5:
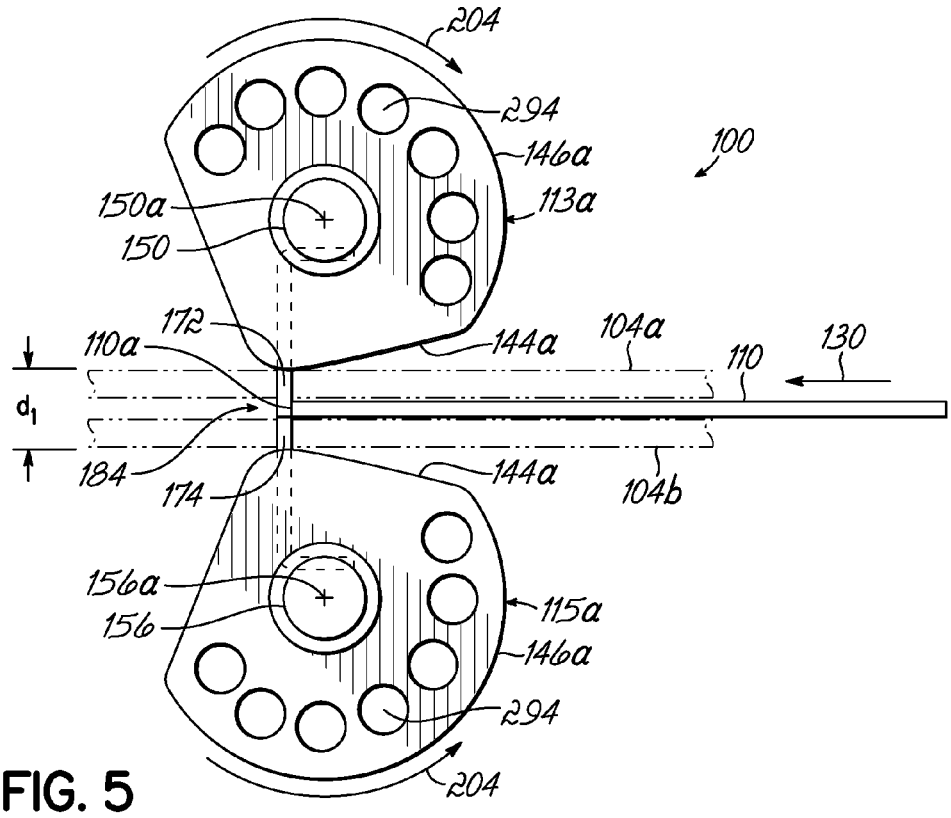
FIG. 5 is an elevation view of a portion of the accumulating apparatus of FIGS. 2-4.
Figure 5A:
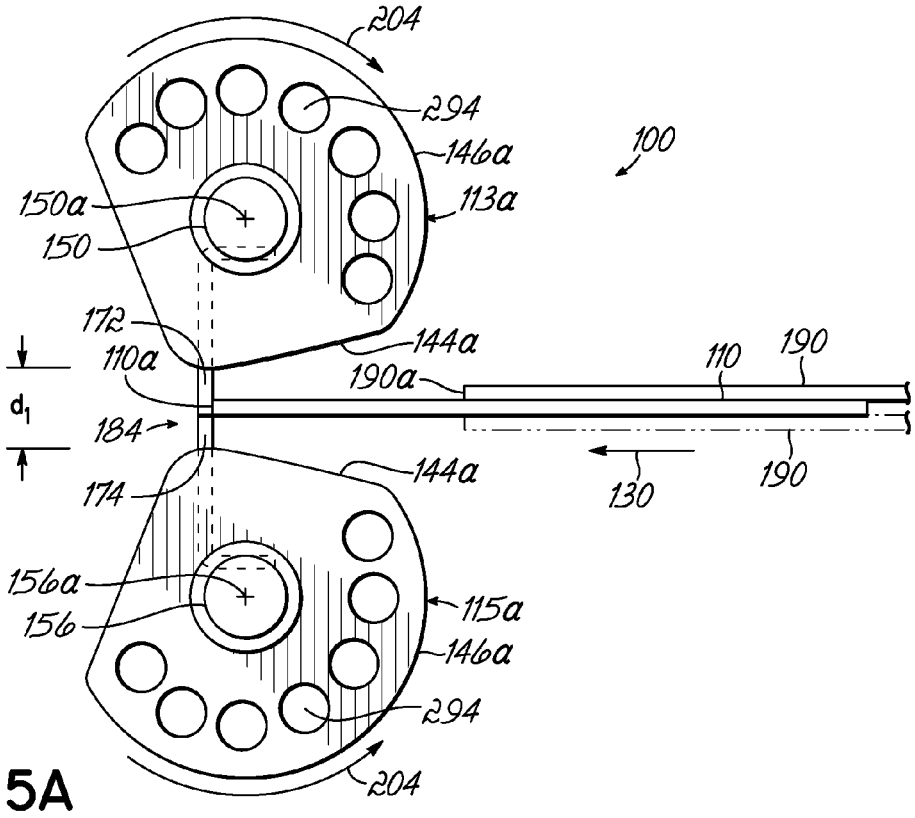

With particular reference to FIG. 5A, a second object 190 is illustrated moving in the machine direction (arrow 130) toward the gap 184, and more specifically, toward the stops 172, 174. Advancement in the machine direction (arrow 130) of this second object 190 is similarly blocked by the stops 172, 174 that prevent forward movement of the first object 110. As suggested by the object drawn in phantom, the second object 190 may alternatively be stacked over or under the first object 110. In this regard, adjustment of the ramp elements 132 (FIG. 2) determine whether the second object 190 is stacked over or under the first object 110. The ramp element 132 may, for example, be manually adjustable or alternatively automatically adjustable to thereby determine which of the two directions (i.e., above or below the first object 110) is followed by the second object 190.

Figure 5B:
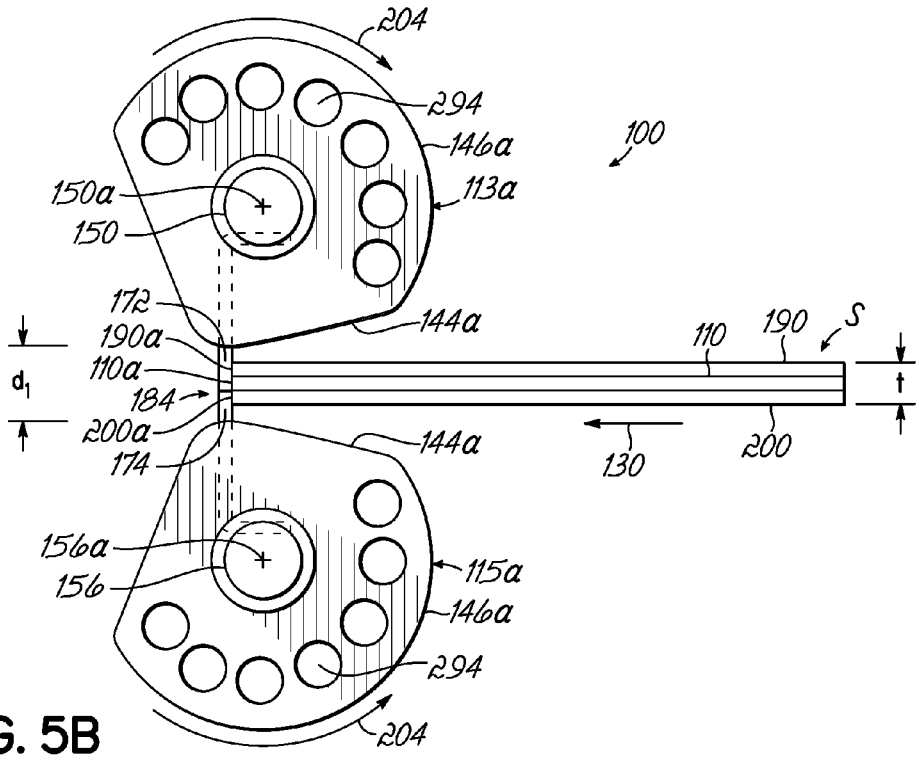

With particular reference to FIG. 5B, an exemplary stack S of first, second and third objects 110, 190, 200 is shown being formed in the gap 184 between the top and bottom accumulator elements 113*a*, 115*a* and in front (i.e., upstream) of the stops 172, 174. As FIG. 5B illustrates, the respective leading edges 110*a*, 190*a*, 200*a* of the first, second and third objects are generally aligned with one another, which thereby results in the formation of a generally uniform stack, which facilitates the handling of the stack downstream of the top and bottom accumulator elements 113*a*, 115*a*. While FIG. 5B illustrates a stack of three objects 110, 190, 200, it is contemplated that a stack of any number of objects may be alternatively formed, with the resulting thickness t of the stack S being only limited by the size $d_1$ of the gap 184.

Figure 6:
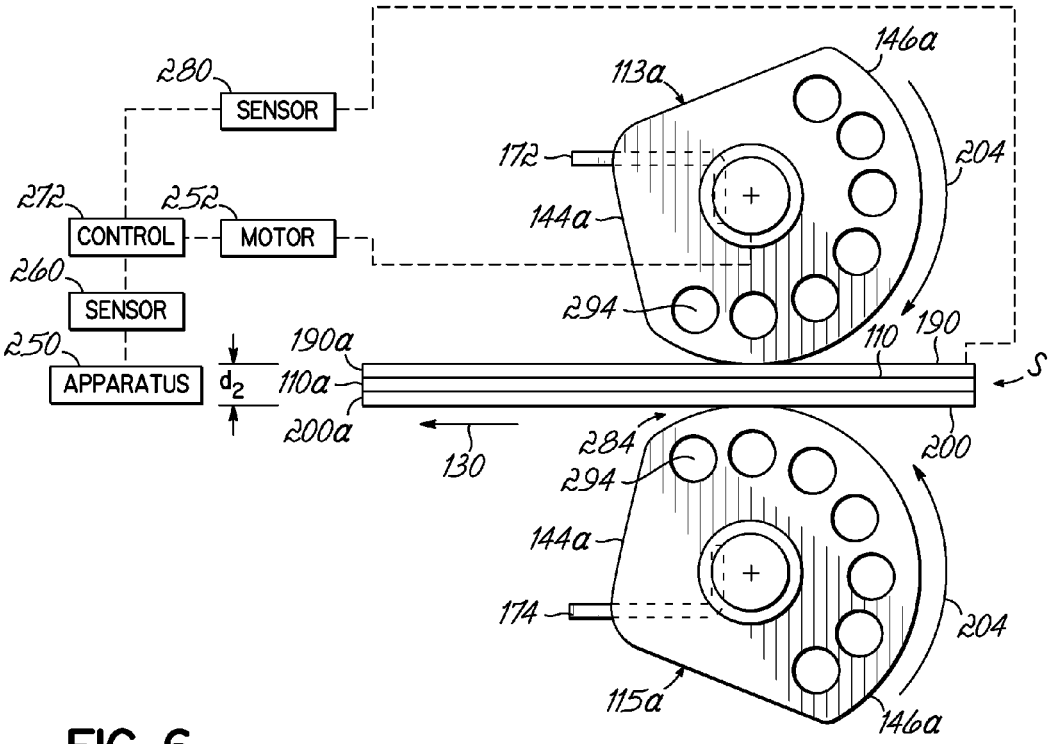
FIG. 6 is an elevation view similar to FIG. 5 showing a pair of accumulator elements of the accumulating apparatus in respective orientations different from those of FIG. 5.

With particular reference to FIG. 6, the top and bottom accumulator elements 113*a*, 115*a* are shown having rotated (arrows 204) to a second angular position of the top and bottom accumulator elements 113*a*, 115*a* so as to cause nipping engagement of the arcuate surfaces 146*a*, 146*b* with the stack S of the objects 110, 190, 200. In this regard, further rotation of the top and bottom accumulator elements 113*a*, 115*a* causes advancement of the stack S in the machine direction (arrow 130) towards a schematically depicted apparatus 250 downstream therefrom. The apparatus 250 may, for example and without limitation, be a pair of rollers or a belt supporting the stack S and operable to move the same in the machine direction (arrow 130). In the second angular position of the top and bottom accumulator elements 113*a*, 115*a*, the top and bottom accumulator elements 113*a*, 115*a* define a second vertical space $d_2$ of the gap 184 that is smaller than the first vertical space $d_1$ of gap 184 associated with the first angular position (FIG. 5) i.e., or stated differently, the accumulator elements 113*a*, 115*a* define a second, smaller gap 284. Rotation from the first angular position of FIG. 5 to the second angular position of FIG. 6 in this embodiment is effected at a first speed, which could, for example, be suitably chosen to gently engage the stack S.

Figure 7:
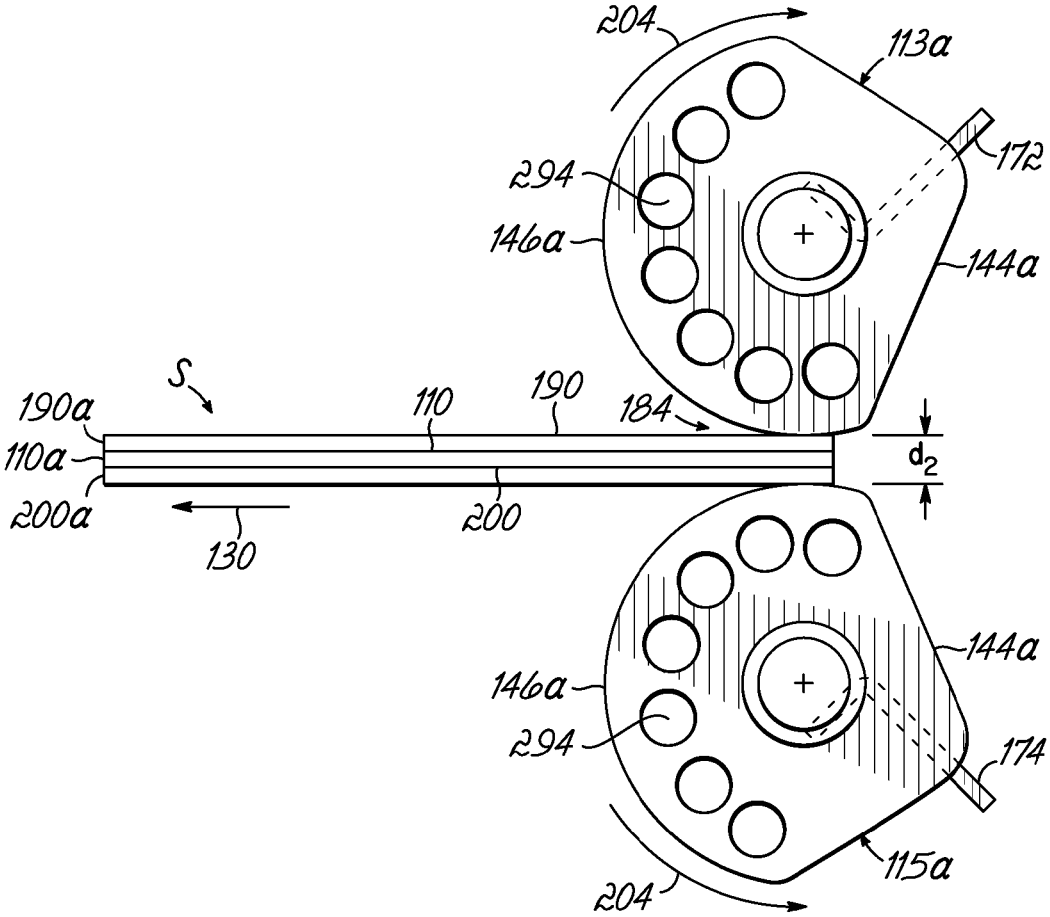
FIG. 7 is an elevation view similar to FIGS. 5 and 6, showing the accumulator elements in an orientation different from those of FIGS. 5 and 6.

With particular reference to FIG. 7, a third angular position of the top and bottom accumulator elements 113*a*, 115*a* is shown which is different from the first and second angular positions (FIGS. 5 and 6). This third angular position is such that the stack S is substantially (i.e., almost completely) discharged from engagement with the top and bottom accumulator elements 113*a*, 115*a* and is advanced toward the apparatus 250 downstream of the accumulator elements 113*a*, 115*a*. In this exemplary embodiment, the speed of rotation of the accumulator elements 113*a*, 115*a* from the second angular position (FIG. 6) to the third angular position (FIG. 7) is effected at a second speed that may be greater or less than the first speed from the first angular position of FIG. 5 to the second angular position of FIG. 6. More specifically, the top and bottom accumulator elements 113*a*, 115*a* may for example be accelerated or decelerated from the second angular position (FIG. 6) to the third angular position (FIG. 7) so as to match a speed of the apparatus 250 downstream of the top and bottom accumulator elements 113*a*, 115*a*, depending of the speed of the apparatus 250. To this end, one or both of the top and bottom accumulator elements 113*a*, 115*a* may be driven by a suitably chosen drive or motor, such as a servo motor 252, that is configured to rotate the top and bottom accumulator elements 113*a*, 115*a* at variable speeds.

It is also contemplated that rotation of the accumulator elements 113*a*. 115*a* may be accelerated from the first angular position (FIG. 5) to the second angular position (FIG. 6) at a first acceleration rate and from the second angular position (FIG. 6) to the third angular position (FIG. 7) at a second acceleration rate different from (e.g., greater or less than) the first acceleration rate. In addition, the accumulator elements 113*a*, 115*a* rotate from the third angular position (FIG. 7) or from a fourth angular position (not shown) in which there is no further engagement with the stack S back to the first angular position (FIG. 5). In specific embodiments, this last rotation from the third or fourth angular positions back to the first angular position may be effected at a speed that is greater than any or all of the speeds associated with rotation of the accumulator elements 113*a*, 115*a* between the first to the second, second to the third, or third to the fourth angular positions. This relatively quick return of the accumulator elements 113*a*, 115*a* to the first angular position increases the throughput of the accumulating apparatus 100 by minimizing the time in which the accumulating apparatus 100 is not in position to receive objects 110 into the gap 184.

Additionally, the accumulating apparatus 100 may include a sensor 260 that may sense the speed of the apparatus 250 downstream of the top and bottom accumulator elements 113*a*, 115*a* and feed the sensed speed to a control unit 272 that controls the speed of the motor 252. In addition or alternatively to the above, the accumulating apparatus 100 may also include a sensor 280 that senses the thickness t of the stack S held in front of the gap 184, and feed the sensed thickness to the control unit 272, to thereby control the magnitude of the first speed of rotation from the first angular position (FIG. 5) to the second angular position (FIG. 6) so as to gently engage the objects 110 forming the stack S.

Those of ordinary skill in the art will readily appreciate that the same principles described above may be applicable to variations of the apparatus described with respect to the above figures. For example, and without limitation, the accumulating apparatus 100 may include a single stop 172, for example, extending only from the top accumulator element 113*a*, rather than a pair of stops 172, 174 extending respectively from the top and bottom accumulator elements 113*a*, 115*a*. Likewise, while the embodiments of the preceding figures include pairs of accumulator elements (e.g., 113*a*, 115*a*) in the form of cams, it is contemplated that an alternative apparatus may include only the top or bottom accumulator element 113*a*, 115*a* having such shape (e.g., having a flat surface 144*a*, 144*b*) and cooperating with a roller rather than with a cam disposed in confronting relationship therewith. Moreover, while the preceding figures show two pairs of top and bottom accumulator elements (113*a*, 115*a* and 113*b*, 115*b* respectively) that are laterally spaced from one another, it is contemplated that an alternative accumulating apparatus may have any number of pairs of opposed accumulator elements other than the two that are shown in the preceding figures.

Materials defining the accumulator elements 113*a*, 115*a*, 113*b*, 115*b* are suitably chosen. For example, one or more of the accumulator elements 113*a*, 115*a*, 113*b*, 115*b* may be made of a relatively hard and/or lightweight material, such as a foam-based material or a foam-like material. Additionally, one or more of the accumulator elements 113*a*, 115*a*, 113*b*, 115*b* may include a coating such as a urethane coating on their surfaces, to thereby provide a predetermined level of hardness and durability to the accumulator elements 113*a*, 115*a*, 113*b*, 115*b*. In addition, other design considerations may be suitably chosen. For example, in this particular embodiment, each of the accumulator elements 113*a*, 115*a*, 113*b*, 115*b* has a plurality of voids 294 that minimize the overall weight of the accumulator elements 113*a*, 115*a*, 113*b*, 115*b*. The voids 294 also facilitate flexing of the accumulator elements 113*a*, 115*a*, 113*b*, 115*b* resulting from their compression when they nip the object 110 or stack S of objects s of 110. This flexibility permits the accumulator elements 113*a*, 115*a*, 113*b*, 115*b* to generally conform with the thickness of the stack S, which facilitates gentle but effective engagement of the stack S and the forward movement thereof resulting from rotation of the accumulator elements 113*a*, 115*a*, 113*b*, 115*b* from the first angular position (FIG. 5) to the second angular position (FIG. 6). In embodiments in which the accumulator elements 113*a*, 115*a*, 113*b*, 115*b* are made of a foam-based material or a foam-like material, the porosity of that material also facilitates flexing of the accumulator elements 113*a*, 115*a*, 113*b*, 115*b* resulting from their compression associated with nipping engagement of the object 110 or stack S of objects s of 110.

Figure 8:
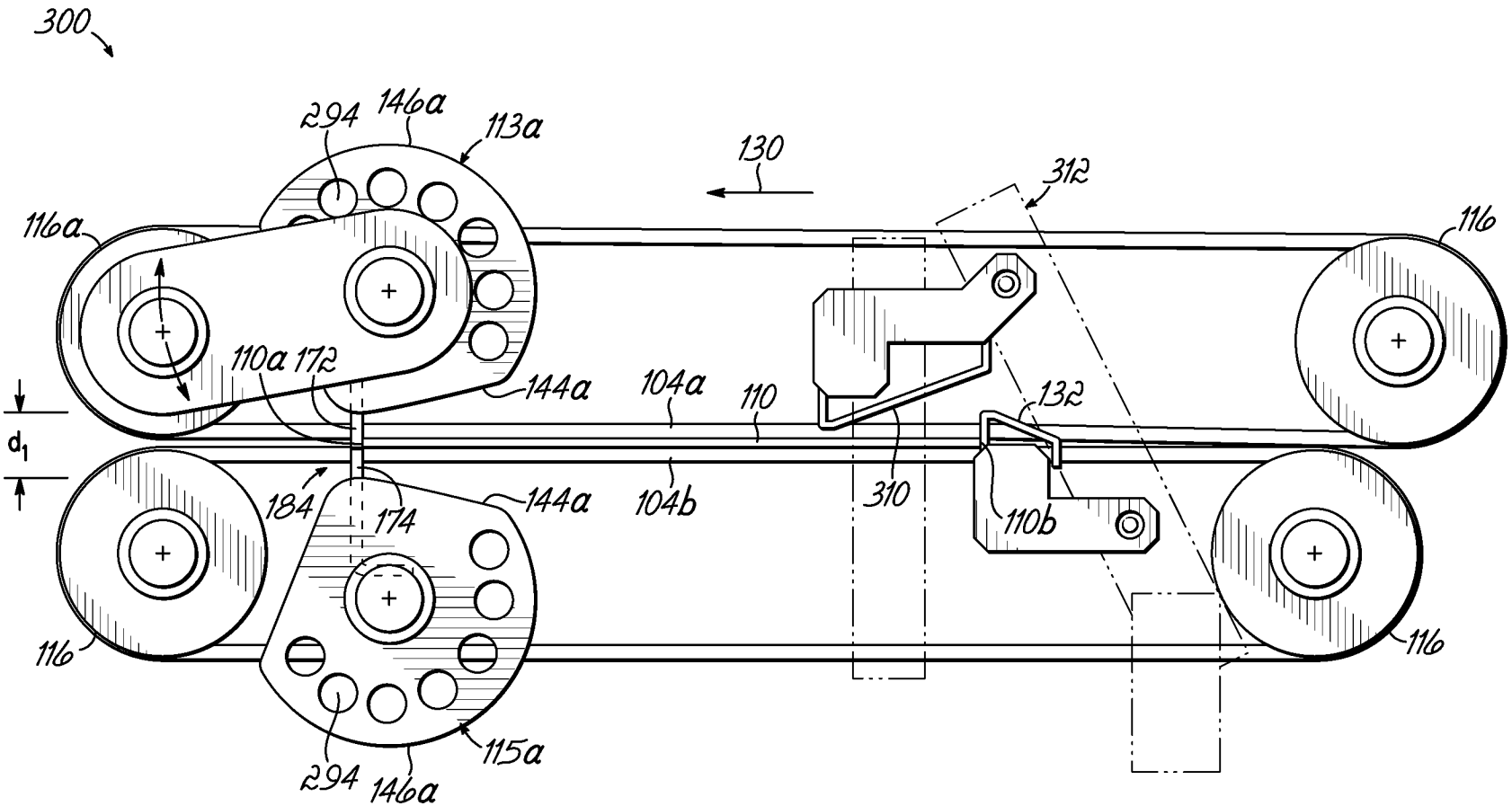
FIG. 8 is an elevation view of another embodiment of an accumulating apparatus.
Figure 9:
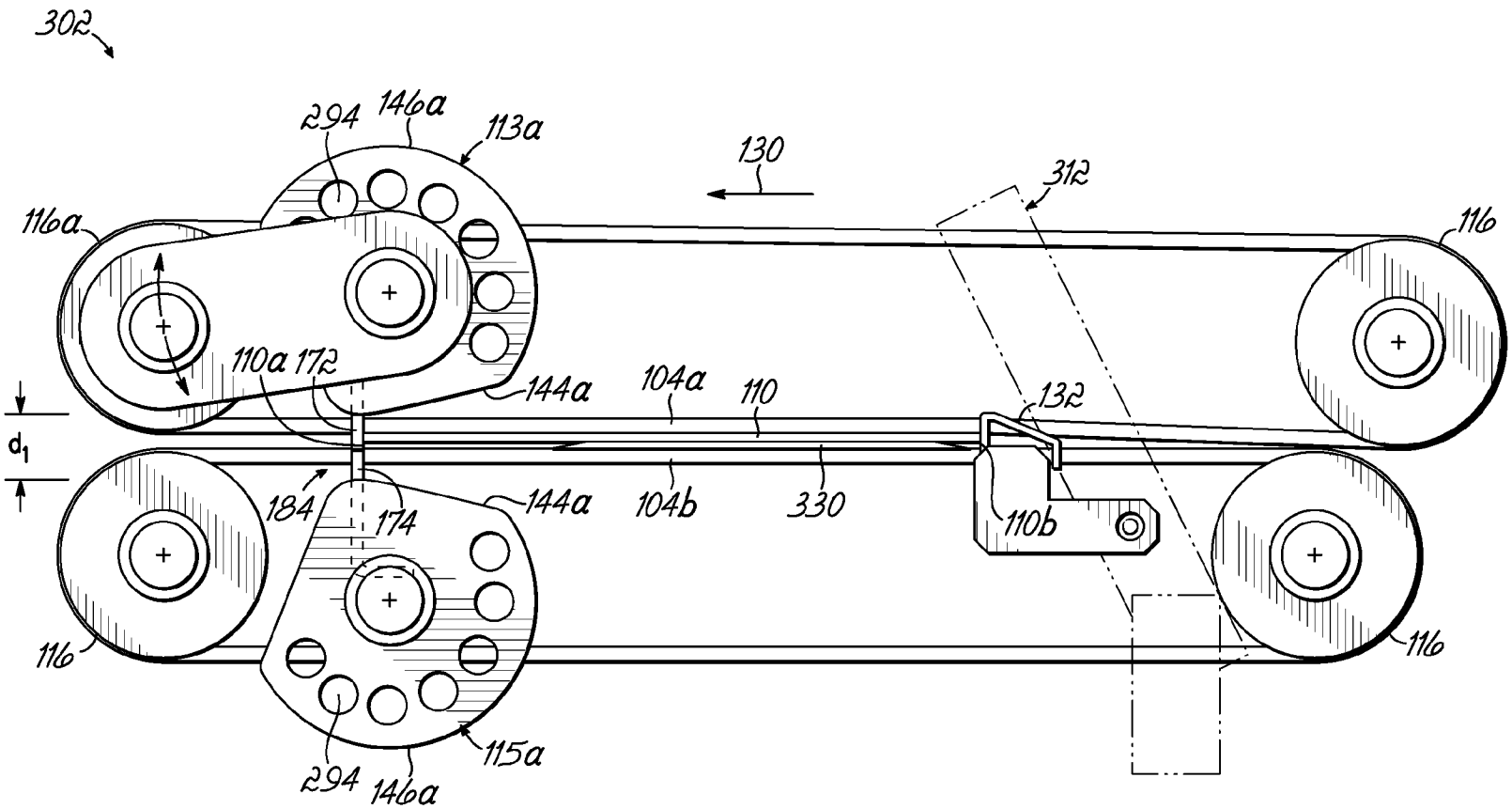
FIG. 9 is an elevation view of yet another embodiment of an accumulating apparatus.

With reference to FIGS. 8 and 9, respective alternative embodiments of accumulating apparatus 300, 302 are illustrated. For ease of understanding, like reference numbers in FIGS. 8 and 9 refer to like features in the preceding figures. With particular reference to FIG. 7, the apparatus 300 includes a first plurality of ramp elements 132 (only one shown) located upstream of a second plurality of ramp elements 310 (only one shown). The ramp elements 132 and 310 are mounted on a common bracket 312 to simultaneously adjust their position in the machine direction (arrow 130) to accommodate objects 110 of different pitch (i.e., length). In the view shown (FIG. 8), the trailing edge 110*b* of the object 110 rests generally against the first ramp elements 132, with every subsequent object being directed above an object 110 resting in front of the gap 184 and having its trailing edge 110*b* generally behind the first ramp elements 132. The upward orientation of each of the ramp elements 132 facilitates directing of the subsequent objects 110 above objects 110 resting as described above. The second ramp elements 310, meanwhile, direct the leading edge 110*a* of each of the objects 110 downward as they travel in the machine direction (arrow 130) toward the gap 184. In this embodiment, mounting of the first ramp elements 132 onto the bracket 312 is such that their vertical position may be adjusted so that only the second ramp elements 310 act upon the objects 110. In this regard, the second ramp elements 310 direct the objects 110 downward, thereby causing every subsequent object 110 to go under objects 110 already in the stack S. In another aspect of this embodiment, a pulley 116*a* is hingedly coupled to the apparatus 300 such that the upper belt 104*a* driven by pulley 116*a* may easily flex in response to the thickness of the objects 110. Flexing of the belt 104*a* in this embodiment may, for example, be in the range of up to 14 mm.

With reference to the exemplary embodiment of FIG. 9, the illustrated apparatus 302 includes no second ramp elements 310 at all, but rather a first plurality of ramp elements 132 and a support plate 330 disposed between the top and bottom belts 104*a*, 104*b* to support the object 110. This support plate 330 may be desirable, for example, to minimize the frictional forces experienced by the objects 110 associated with slipping movement in the machine direction (arrow 130) of the belts, 104*a*, 104*b* relative to the objects 110, as the objects 110 are blocked from forward movement by the stops 172, 174 (FIG. 5).

While the present invention has been illustrated by a description of various embodiments and while these embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods, and illustrative example shown and described. Accordingly, departures may be made from such details without departing from the spirit or scope of the general inventive concept.

What is claimed is:

1. An apparatus for accumulating discrete paper or film objects traveling in a machine direction, comprising:

a first accumulator element rotatable about a first axis of rotation;

a second accumulator element disposed in confronting relationship with said first accumulator element, said first accumulator element having a first, generally flat surface and a first arcuate surface both rotatable about the first axis of rotation, said first accumulator element having a first angular position with said first flat surface defining a first gap relative to said second accumulator element for receiving the objects there between, and a second angular position with said first arcuate surface defining a second gap relative to the second accumulator element for moving the objects in the machine direction, said second gap being smaller than said first gap;

a stop oriented transverse to said first axis of rotation and rotatable thereabout, said stop being configured to prevent movement of the objects in the machine direction when said first accumulator element is in said first angular position, and said first accumulator element being spaced from said second accumulator element when in both said first and second angular positions.

2. The apparatus of claim 1, wherein said second accumulator element is rotatable about a second axis of rotation, said first and second accumulator elements being oriented such that said first and second axes of rotation are generally parallel to one another.

3. The apparatus of claim 2, wherein said second accumulator element includes a second, generally flat surface and a second arcuate surface, both rotatable about said second axis of rotation.

4. The apparatus of claim 3, wherein said first and second generally flat surfaces are in confronting relationship with one another when said first accumulator element is in said first angular position.

5. The apparatus of claim 1, wherein said stop and said first accumulator element are mounted on a common shaft.

6. The apparatus of claim 1, wherein said second accumulator element is rotatable about a second axis of rotation, the apparatus further comprising:

a second stop oriented transverse to said second axis of rotation and rotatable thereabout, said second stop cooperating with said first stop to prevent movement of the objects in the machine direction when said first accumulator element is in said first angular position.

7. The apparatus of claim 1, wherein at least one of said first or second accumulator elements includes a plurality of voids to minimize the weight of said at least one of said first or second accumulator elements.

8. The apparatus of claim 1, wherein said first accumulator element is sufficiently elastic to facilitate flexing of said first accumulator element during compression thereof associated with engagement of the objects.

9. The apparatus of claim 8, wherein said first accumulator element includes a urethane coating.

10. The apparatus of claim 1, further comprising:

a motor operatively coupled to said first accumulator element and operable to rotate said first accumulator element at a first speed from the first angular position to said second angular position and at a second speed from said second angular position toward a third angular position of said first accumulator element different from said first and second angular positions, said first speed being different from said second speed.

11. The apparatus of claim 1, further comprising:

a pair of belts in confronting relationship with one another and configured to nip and move the objects into said first gap.

12. The apparatus of claim 11, further comprising:

a plate located between said pair of belts and positioned to support the objects immobilized by said stop, said plate being configured to minimize friction between the immobilized objects and one of said belts.

13. The apparatus of claim 11, further comprising:

a ramp element positioned relative to said belts so as to direct a first one of the objects above or below a second one of the objects immobilized by said stop.

14. The apparatus of claim 11, wherein said pair of belts are mounted on respective pulleys, a first one of said pulleys being pivotally mounted to permit relative movement of said belts relative to one another in response to a thickness of the objects received in said first gap.

15. An apparatus for accumulating discrete paper or film objects traveling in a machine direction, comprising:

a first cam rotatable about a first axis of rotation;

a second cam disposed in confronting relationship with said first cam and rotatable about a second axis of rotation generally parallel to said first axis of rotation;

a first stop oriented transverse to said first axis of rotation and rotatable thereabout; and a second stop oriented transverse to said second axis of rotation and rotatable thereabout, wherein:

said first and second cams have a first common angular position defining a first gap between them, and a second common angular position defining a second gap between them, said first gap is wider than said second gap and is configured to receive the objects there between, and said second gap is effective to nip the objects there between to move the objects in the machine direction, and said first and second stops are configured to prevent movement of the objects in the machine direction when the objects are received in said first gap.

16. The apparatus of claim 15, further comprising:

a motor operatively coupled to said first and second cams and operable to rotate said cams at a first speed from said first common angular position to said second common angular position and at a second speed from said second common angular position toward a third common angular position different from said first and second common angular positions, said first speed being different from said second speed.

17. The apparatus of claim 15, further comprising:

third and fourth cams disposed in confronting relationship with one another and laterally spaced from said first and second cams, respectively, said third cam being mounted on a first common shaft with said first cam and said fourth cam being mounted on a second common shaft with said second cam.

18. The apparatus of claim 17, wherein said first stop is mounted on said first common shaft and said second stop is mounted on said second common shaft.

19. An automatic converting apparatus having a first end associated with feeding of a roll of paper in a machine direction, a portion configured to process the roll of paper into discrete paper objects, and a second end associated with feeding of envelopes toward the discrete objects, the converting apparatus further comprising:

an accumulating apparatus for accumulating the discrete objects traveling in the machine direction, said accumulating apparatus including (a) first and second accumulator elements disposed in confronting relationship with one another, said first accumulator element being rotatable about a first axis of rotation and having a first angular position defining a first gap relative to said second accumulator element for receiving the discrete objects there between, and a second angular position defining a second gap relative to said second accumulator element for nipping and moving the discrete objects in the machine direction, said second gap being smaller than said first gap;

(b) a stop oriented transverse to said first axis of rotation and rotatable thereabout, said stop being configured to prevent movement of the discrete objects in the machine direction when said first accumulator element is in said first angular position; and (c) said first accumulator element being spaced from said second accumulator element when in said first and said second angular positions.

20. A paper sheet stacking apparatus including:

two accumulator elements having opposed surfaces defining first and second spaced apart paper receiving nips, said first nip being wider than said second nip; and a stop for blocking leading edges of successively fed paper sheets in the same position and thereby form a stack of sheets having a uniform leading edge, the sheets being oriented within said first nip, said stop oriented in laterally spaced disposition from said nip.

21. The apparatus of claim 20, wherein said accumulator element is rotatable to define said second nip for engaging and driving said formed stack in a downstream direction.

22. A method for accumulating discrete paper or film objects traveling in a machine direction, the method comprising:

defining a first gap between first and second accumulator elements to receive the objects there between, the first gap being associated with a first angular position of the first accumulator element;

rotating the first accumulator element to define a second gap between the accumulator elements associated with a second angular position of the first accumulator element, the second gap being smaller than the first gap, wherein engagement of the objects with surfaces defining the second gap is effective to move the objects in the machine direction; and blocking movement of the objects traveling in the machine direction when the objects are received in the first gap.

23. The method of claim 22, wherein rotation of the first accumulator element from the first to the second angular position is effected at a first speed, the method further comprising:

rotating the first accumulator element from the second angular position to a third angular position different from the first and second angular positions at a second speed different from the first speed.

24. The method of claim 22, further comprising:

sensing an object conveying speed downstream of the first and second accumulator elements in the machine direction; and adjusting the speed of rotation of the first accumulator element to match the sensed speed.

25. The method of claim 22, further comprising:

sensing a thickness of a stack of the objects formed in the first gap; and adjusting the speed of rotation of the first accumulator element in response to the sensed thickness.

26. The method of claim 22, further comprising:

rotating the first accumulator to a third angular position different from the first and second angular positions;

rotating the first accumulator element from the third angular position toward the first angular position;

stopping rotation of the first accumulator element when the first accumulator element reaches the first angular position, wherein rotation of the first accumulator element from the third to the first angular position is effected at a speed greater than the speeds of rotation thereof from the first to the second or from the second to the third angular positions.

27. The method of claim 26, wherein rotation of the first accumulator element from the third to the first angular position is effected at a speed greater than the speeds of rotation thereof from the first to the second or from the second to the third angular positions.

28. A method for accumulating a plurality of paper or film objects, the method comprising:

moving a first one of the objects in a machine direction into a space defined between a pair of rotatable, spaced apart and non-engaged accumulator elements in a non-rotating angular position;

moving a second one of the objects toward a position above or below the first object to thereby form a stack of the objects;

supporting the stack of objects with an apparatus downstream from the accumulator elements and operable to move the stack in the machine direction at a first speed; and accelerating rotation of the accumulator elements from the non-rotating position to a transfer position in which the stack of the objects is moving substantially at the first speed of the apparatus downstream and the stack of the objects is transferred away from engagement between the accumulator elements and into engagement with the apparatus downstream thereof.

29. The method of claim 28, further comprising:

accelerating rotation of the accumulator elements from the non-rotating angular position to an intermediate position at a first acceleration rate, the intermediate position being between the non-rotating position and the transfer position; and accelerating rotation of the accumulator elements from the intermediate position to the transfer position at a second acceleration rate different from the first acceleration rate.

30. The method of claim 29, wherein the second acceleration rate is greater than the first acceleration rate.

31. The apparatus of claim 4 wherein said first and second generally flat surfaces are oriented at an angle to each other when said first accumulator element is in said first angular position.

32. The apparatus of claim 1 wherein said stop is laterally displaced from each of said first and second accumulator elements.

33. The apparatus of claim 1 wherein said stop is discrete from each accumulator element.

34. The apparatus of claim 1 wherein the first arcuate surface of said first accumulator element traverses a first circumferential path and wherein said stop has an outer end which traverses another second circumferential path oriented radially outwardly of said first path when said first accumulator element rotates about said first axis.

* * * * *